United States Patent [19]

Roderburg

[11] 4,435,968

[45] Mar. 13, 1984

[54] APPARATUS FOR CORRUGATING PIPES

[75] Inventor: Harald Roderburg, Langenhagen, Fed. Rep. of Germany

[73] Assignee: Kabel-und Metallwerke Gutehoffnungshütte Aktiengesellschaft, Hanover, Fed. Rep. of Germany

[21] Appl. No.: 282,619

[22] Filed: Jul. 13, 1981

[30] Foreign Application Priority Data

Aug. 2, 1980 [DE] Fed. Rep. of Germany ..... 3029447
Aug. 2, 1980 [DE] Fed. Rep. of Germany ..... 3029448

[51] Int. Cl.[3] ..... B21D 15/04
[52] U.S. Cl. ..... 72/77
[58] Field of Search ..... 72/77, 78, 98, 103

[56] References Cited

U.S. PATENT DOCUMENTS 3,260,088 7/1966 Gruetter et al. ..... 72/103
3,572,074 3/1971 Holdup et al. ..... 72/77
3,656,331 4/1972 Kuypers et al. ..... 72/77
3,796,078 3/1974 Vaill ..... 72/77

FOREIGN PATENT DOCUMENTS 1900953 2/1970 Fed. Rep. of Germany .
49-43069 11/1974 Japan .
51-548 1/1976 Japan ..... 72/77
54-148172 11/1979 Japan ..... 72/77

*Primary Examiner*—Lowell A. Larson
*Attorney, Agent, or Firm*—Martin A. Farber

[57] ABSTRACT

An apparatus for the corrugation of pipes of plastically deformable material, particularly of cable sheathings of metal, through which the pipe is continuously passed, comprising a corrugator rolling bushing having an inside surface with a deformation rib which is helical (when annular parallel corrugations are to be produced on the pipe) of more than one thread, or with at least one deformation rib acting on successive points viewed in the longitudinal direction of the pipe (when helical corrugations are to be produced in the pipe), the corrugator rolling bushing being supported for free rotation in a rotatable corrugator head, the inside diameter of the corrugator rolling bushing being larger than the diameter of the pipe to be corrugated and the corrugator rolling bushing being supported eccentrically to the pipe. The ratio of the inner diameter of the inside diameter defined formed by the deformation rib or ribs to the outside diameter of the corrugated pipe in the region of a corrugation valley thereof is 2:1, or an integral multiple thereof, with a maximum deviation of 5%.

18 Claims, 7 Drawing Figures

APPARATUS FOR CORRUGATING PIPES

FIELD OF THE INVENTION

The present invention relates to an apparatus for the corrugation of pipes of plastically deformable material, particularly of cable sheathings of metal, through which the pipe is continuously passed, consisting of a corrugator rolling bushing with a helically extending deformation rib (when annular parallel corrugations are to be produced on the pipe) of more than one thread on its inner surface or with at least one deformation rib arranged on its inner surface and acting on successive points viewed in the longitudinal direction of the tube (when helical corrugations are to be produced in the pipe), the corrugator rolling bushing being supported for free rotation in a rotatable corrugator head, the inside diameter of the corrugator rolling bushing being larger than the diameter of the pipe to be corrugated and the corrugator rolling bushing being supported eccentrically to the pipe.

BACKGROUND

In one apparatus (East German Pat. No. 59 536) a bushing provided with a helical rib is fastened eccentrically on a support which rotates around the longitudinal axis of the pipe to be corrugated. In this device the bushing is fastened on the support at an angle to the longitudinal axis of the pipe, whereby a sufficiently deep corrugation is produced.

A similar device (West German OS No. 19 00 953) consists of a bushing with threading which is also fastened eccentrically on a support which rotates around the longitudinal axis of the pipe.

The two devices have the feature in common that the inside diameter of the corrugation tool or bushing is larger than the outside diameter of the pipe to be corrugated. Since in both devices the bushings are fastened in a freely rotatable manner and eccentrically on the carrier, the bushings roll on the surface of the pipe upon rotation of the carrier and sufficient eccentricity and thereby produce the annular parallel corrugation.

It has, however, been found that the corrugation produced with the known devices is not suitable for many purposes of use since it is not uniform over the length of the pipe. Thus, for instance, a corrugation which is completely equal or the same over the length of the pipe is necessary for application in high-frequency electromagnetic wave technology. Furthermore, the corrugation should be free of deformations in the region of the flanks of the corrugations and be as close as possible to a sinusoidal curve form. Also a helical corrugation cannot be produced with these devices.

OBJECT OF THE INVENTION

The object of the present invention is to avoid the above-identified disadvantages and to improve the known device in such a manner that it is possible with it to produce annularly or helically, respectively, corrugated pipes having a uniform corrugation which satisfies even the highest requirements.

SUMMARY OF THE INVENTION

This purpose is achieved in the manner that, in accordance with the invention, the ratio of the inner diameter (D) of the inside diameter (of the deformation rib of the helix (FIG. 1) or of the annular ribs (FIG. 2)) which is defined or formed by the deformation ribs (10, 10*a*; 10', 10*a'*) to the outside diameter (d) of the corrugated pipe (13, 13') in the region of a corrugation valley thereof is 2:1, or an integral multiple thereof, with a maximum deviation of 5%, and when the apparatus is to produce a helical corrugation on the pipe, in addition, the deformation rib comprises a plurality of annular parallel ribs arranged equally spaced from each other. The invention is based in this connection on the discovery that in order to produce a suitable corrugation with a thread-like deformation rib having more than one thread (when annular parallel corrugations are to be produced on the pipe) or with a plurality of annular deformation ribs (when a helical corrugation is to be produced on the pipe), the rear threads or deformation ribs, respectively, as seen in the direction of passage must engage precisely into the corrugation valley produced by the preceding thread turn or deformation rib, respectively, and do so as far as possible at the same place, viewed in the circumferential direction, where the corresponding region of the preceding thread or deformation rib, respectively, produced the corrugation. From this there results the requirement that the speed of rotation of the corrugator head must be twice as great as the rolling speed of the corrugator rolling bushing or else may be an integral multiple thereof. This requirement is satisfied by the measures in accordance with the invention.

For corrugated pipes of highest quality the maximum deviation should be at most 1%.

A deviation of 0% would be ideal, but for economical considerations it makes sense to permit a certain deviation. Although there is no substantial relative movement between the helical corrugator bushing 8, 8*a* (when annular parallel corrugations are to be produced on the pipe) or the corrugator rolling bushing 8', 8*a'* (when a helical corrugation is to be produced on the pipe) and the corrugated pipe, the helical corrugator bushing (8, 8*a*) or the corrugator rolling bushing (8', 8*a'*), respectively, is nevertheless subject to a certain amount of wear. In order to increase the life of the corrugator bushing it will therefore be manufactured with excess material, i.e. plus tolerance and left in the apparatus until it wears down to at most 5% minus tolerance (tool diameter to tube diameter).

The deformation rib should constitute at least three thread turns (when annular parallel corrugations are to be produced on the pipe) or at least three annular deformation ribs (when a helical corrugation is to be produced on the pipe). In this connection the rear threads (R) or rear deformation ribs, respectively, determine the size of the corrugation without causing any substantial deformation. The first threads do the main work and the rear threads do the sizing and smoothing. If a particularly deep corrugation is to be produced, it has been found advisable for the height of the deformation rib (10) to increase uniformly at the start of the thread over a region of at least 360 degrees until it reaches the maximum height (FIG. 6) or for the height of the annular deformation ribs (10') to increase from the inlet until it reaches the maximum height (FIG. 7). The spacing or pitch of the threads or the spacing of the annular deformation ribs remains in this connection the same. In particular, the inlet region should extend over at least 720 degrees with the helical thread or over at least two of the annular deformation ribs. For producing annular parallel corrugations on the pipe if one uses a corrugator rolling bushing (8, 8*a*) in which two or more deformation ribs (10, 10*a*) are arranged (a multi-thread screw FIG. 4) then, with the same speed of production, the speed of rotation of the corrugator head can be reduced or, with the same speed of rotation of the corrugator head, the production speed can be increased since the production speed is determined by the product of the pitch of the deformation rib and the speed of rotation of the corrugator head.

In accordance with another concept of the invention, it is contemplated that a further corrugator rolling bushing (8*a*, 8*a*′) be arranged in the corrugator head (1*a*, 1*c*) behind the corrugator rolling bushing (8, 8′) as seen in the direction of passage, the eccentricity of which further bushing is staggered 180 degrees with respect to the first corrugator rolling bushing (8, 8′) and which is so aligned relative to the deformation rib (10) or deformation ribs (10′) of the first corrugator rolling bushing (8, 8′) that its deformation rib (10*a*) or deformation ribs (10*a*′) engage(s) into the corrugation valleys of the corrugated pipe (13, 13′). By the provision of two corrugator rolling bushings the deformation (bending) forces are taken up within the tool and no further support for the pipe is necessary other than entrance bushings. One rigid support can be provided for both tools (8, 8*a*; 8′, 8*a*′). Set screw (17, 17*a*) are provided which are both exactly eccentrically set such that the eccentricity is equal to each other.

With the apparatus for producing annular corrugations on the pipe, between the two corrugator rolling bushings (8, 8*a*) an annular disc (11) is arranged concentrically relative to the pipe (13), and formed with two longitudinal slots (14, 15) extending in the radial direction thereof 180 degrees apart. Pins (16) arranged at the ends of the bushings (8, 8*a*) are guided in the slots. This annular disc provides assurance that the two corrugator rolling bushings are always synchronous with each other. During their eccentric rotation around the metal pipe to be corrugated the pins move in the longitudinal slots.

In order to obtain a dependable corrugation it is advantageous to mount the corrugators (2, 2*a*) with no play in the corrugator head (1*a*, 1*c*) in the axial direction. This can be done, for instance, by two ball bearings arranged at a distance spaced apart from each other or by a needle bearing. As already mentioned above, the corrugator rolling bushings are driven by rolling on the surface of the pipe.

However, there is also the possibility of coupling the corrugators (2, 2*a*) and the corrugator rolling bushings via a gearing or transmission with the drive of the corrugator head (1*a*). However, this type of drive is rather complicated so that use should be made of it only when it is desired to produce a corrugation which satisfies the very highest demands.

BRIEF DESCRIPTION OF THE FIGURES

With the above and other objects and advantages in view, the present invention will become more clearly understood in connection with the detailed description of preferred embodiments, when considered with the accompanying drawings, of which.

DETAILED DESCRIPTION OF PREFERRED EMBODIMENTS

Figure 1:
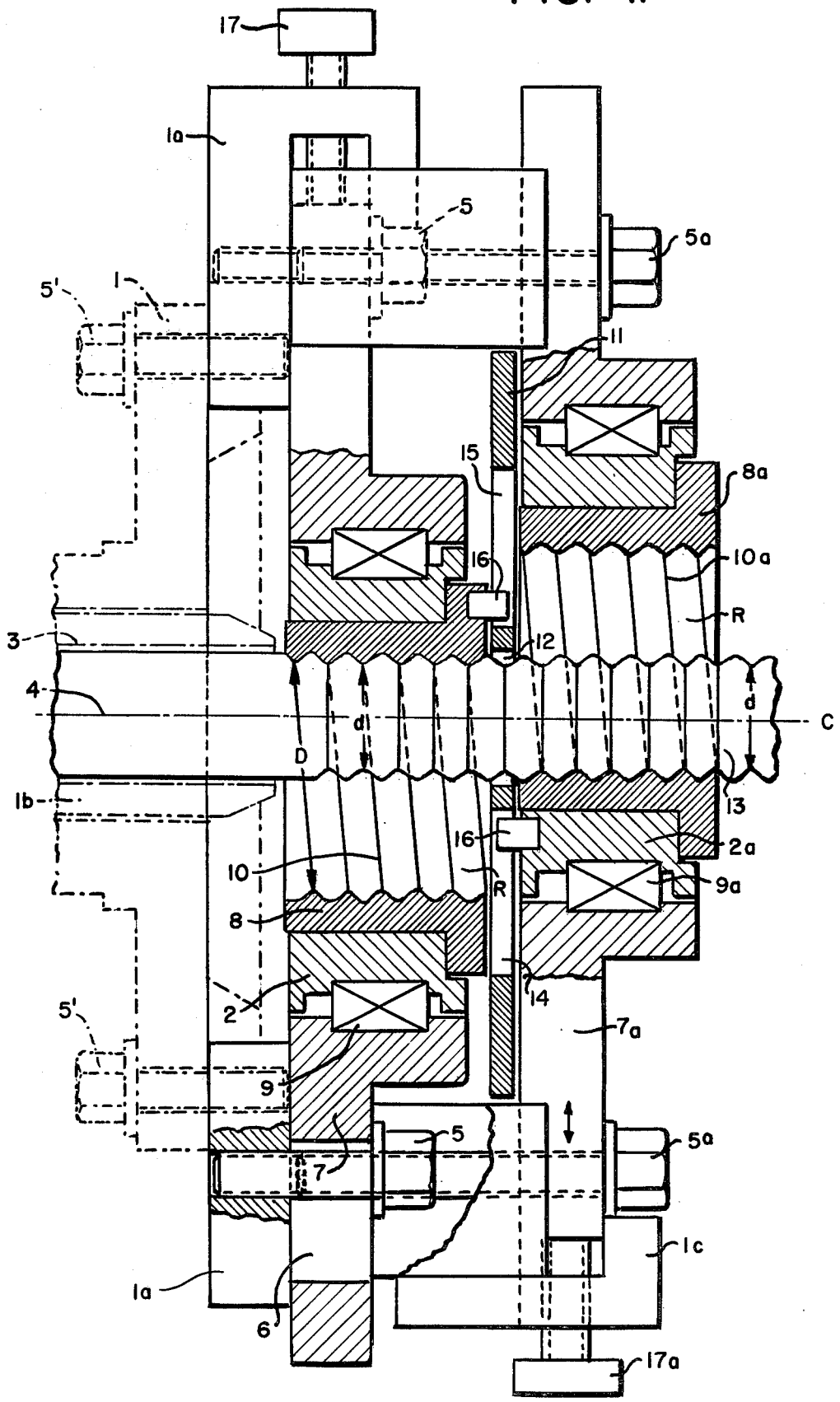
FIG. 1 is a longitudinal cross-section through the apparatus of the invention for producing annular corrugations.
Figure 2:
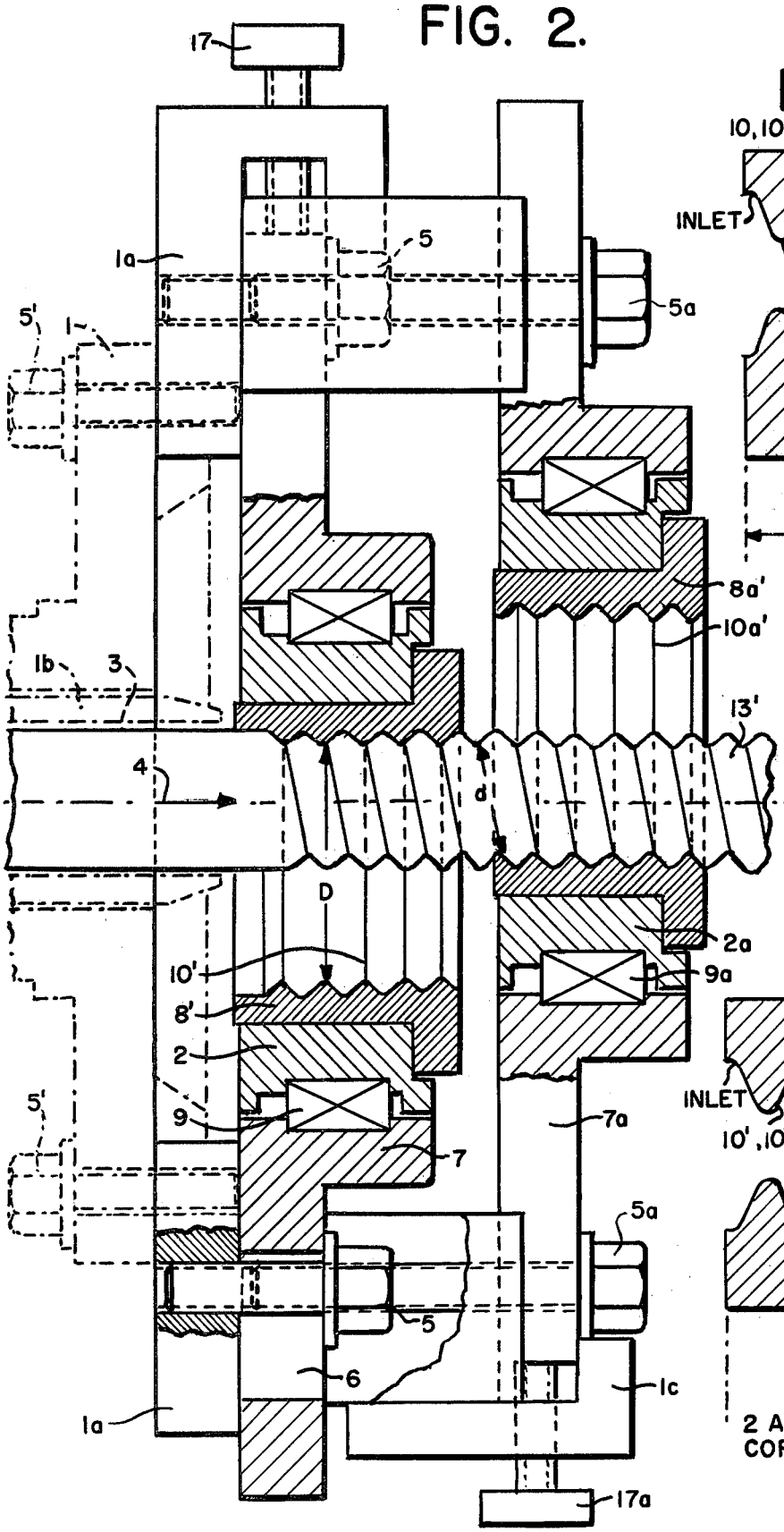
FIG. 2 is a longitudinal cross-section through the apparatus of the invention for producing helical corrugations.
Figure 6:
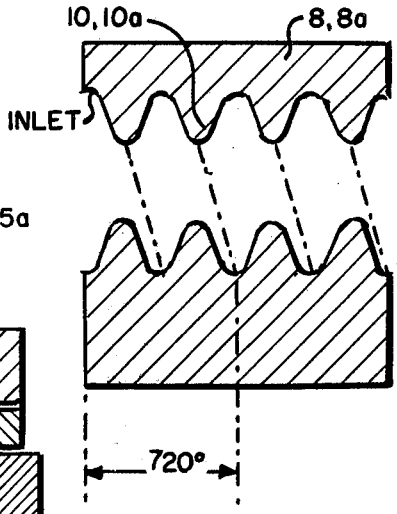
FIGS. 6 and 7 are longitudinal cross-sectional views of corrugator roller bushings having deformation rib(s) which increase(s) at the beginning of the corrugation rib(s).
Figure 7:
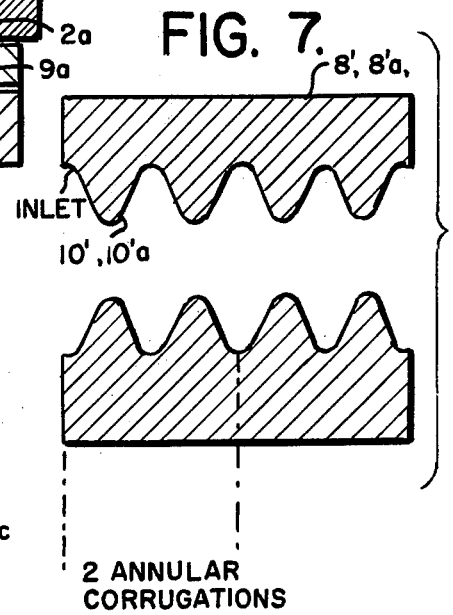

Referring now to the drawings and particularly to FIGS. 1–2 (and FIG. 3 where identical parts are designated with the same reference characters and corresponding parts have the same but primed reference characters), a corrugator 2 is removably arranged on a driven hollow shaft 1 of a known corrugating device which is preferably part of a pipe manufacturing unit in which a longitudinally entering metal strip was shaped (in a manner not shown) into an open seam pipe, then was longitudinally welded to form pipe 4, and thereupon is to be corrugated. The hollow shaft 1 has a passage opening 3 for the longitudinally welded smooth pipe 4. The corrugator 2 (which is a bushing) is fastened eccentrically on a corrugator head 1*a* which is screwed to and jointly rotatable with the hollow shaft 1 for example screws 5′. Screws 5 which pass through slots 6 in a corrugator mount 7 jointly rotatably connect the corrugator head 1*a* with the mount 7, the latter being eccentrically mounted in the corrugator head 1*a*. A corrugator rolling bushing 8 is screwed into the corrugator 2 so as to be jointly rotatable therewith and together is supported for free rotation via ball bearings 9 in the corrugator mount 7. The corrugator rolling bushing 8 has, as shown in FIG. 1 for producing annular corrugations on the pipe 4, a deformation rib 10 with five helical screw thread turns, or as shown in FIG. 2 for producing a helical corrugation, five annular deformation ribs 10′ equally spaced apart from one another. The pipe 4 is held non-rotatable, by means not shown, and its longitudinal axis C is fixed, the axis C likewise being the fixed coaxial central axes of the opening 3, of a support bushing 1*b* disposed therein for the pipe 4, of the shaft 1 and of the corrugator head 1*a*. The pipe 4, however, is moved longitudinally as indicated by the arrows in FIGS. 1 and 2, by means known per se whereby the axial speed of the pipe is synchronized to the corrugator rpm, such that a 360 degree corrugation formed on the pipe corresponds to the pitch, so that the deformation rib(s) fall(s) into the corrugation(s) produced on the pipe.

A similar corrugator 2*a* with corrugator rolling bushing 8*a* or 8*a*′ is arranged behind the corrugator 2, as seen in the direction of passage of the pipe 4, in the corrugator mount 7*a* eccentrically mounted in corrugator head 1*c*, the only difference being that the eccentricity of the corrugator 2*a* is offset 180 degrees relative thereto so that the deformation rib 10*a* or deformation ribs 10*a*′ (FIG. 2) in the corrugator rolling bushing 8*a* or 8*a*′, respectively, act(s) on the pipe 4 on the side opposite that on which the deformation rib 10 or deformation ribs 10′ (FIG. 2) act(s).

With the apparatus for producing annular corrugations on the pipe (FIG. 1), between the corrugator rolling bushings 8 and 8*a* there is arranged a disc 11 which has a passage opening 12 for the pipe, namely for the corrugated portion of the pipe 4 which is referred to as corrugated pipe 13 as well as two radially extending slots 14 and 15 into which there engage pins 16 fastened to the corrugators 2 and 2a.

With respect to the distance between the corrugators 2 and 2a (as well as with respect to their position in the circumferential direction with the apparatus of FIGS. 1–2 for producing annular corrugations), the corrugator rolling bushing 8a or 8a' is so aligned that its deformation rib 10a or deformation ribs 10a' (FIG. 2) engage(s) precisely into the corrugation(s) produced by the deformation rib(s) 10 or 10'. Upon rotation of the hollow shaft 1 and the corrugator head 1a, respectively, the corrugators 2 and 2a travel eccentrically around the pipe axis C and in this manner press annular or helical corrugations into the pipe 4 by means of the deformation ribs 10 and 10a (FIG. 1) or 10' and 10a' (FIG. 2), respectively, in the corrugator rolling bushings 8, 8a; 8' and 8a'. In this manner, the corrugator rolling bushings 8, 8a; 8' 8a' roll on the surface of the pipe.

In operation the corrugator mounts 7 and 7a which are connected by screws 5a are jointly rotatably connected and driven for rotation about their common center C by rotating the shaft 1. This causes the eccentric corrugator mounts 7 and 7a which are jointly rotatably connected with the heads to rotate once and orbit once about the center C for each rotation of the corrugator heads. However, since the pipe 4 is non-rotatable and is frictionally rollably engaged by the corrugator rolling bushings 8, 8a or 8', 8a' (which in turn are rotatably displaceable relative to the mounts 7, 7a via bearings 9, 9a) and due to the fact that the ratio of the inner diameter D of the corrugator rolling bushings 8, 8a; 8', 8a' to the outer diameter d of the corrugations in the region of a corrugation valley, as shown in example, is 2:1, the corrugator rolling bushings 8, 8a; 8', 8a', respectively, roll completely around the pipe engaging the pipe with 360 degrees of its surface once (i.e., the corrugator rolling bushings orbit twice but rotate once) when the corrugator head 1a, 1c has turned twice (note, however, that with respect to the surface of the pipe 4 it is rolled around twice, that is, 180 degrees rolling engagement of the surface of the bushing 8, 8a; 8', 8a' against the pipe produces a full 360 degrees of corrugation on the pipe 4, and when a bushing 8, 8a or 8', 8a' rolls once with 360 degrees of its surface completely around the pipe, with the apparatus of FIG. 1 it produces two parallel corrugations on pipe 13 noting that the pipe 4 moves forward corresponding to the pitch of the helical ribs 10, 10a—and with the apparatus of FIG. 2 it produces a corrugation of two helical turns on the pipe 13'). In this way, it is assured that the following screw thread turns (FIG. 1) of the deformation ribs 10 and 10a or the following deformation ribs 10' and 10a' (FIG. 2) will engage precisely in the corrugation of the pipe 13 and 13', respectively. The following thread turns of FIG. 1 (or the following deformation ribs of FIG. 2), particularly the helical thread turns of the deformation rib 10a of FIG. 1 (or the deformation ribs 10a' of FIG. 2), serve essentially for sizing and smoothing out the shape of the corrugations. The corrugator 2a, furthermore, has the task of taking up the deformation forces.

The eccentricity of the corrugators 2 and 2a is adjusted as known per se via set screws 17 and 17a, respectively, which are adjustably screwed through the heads 1a and 1c, respectively, to adjust the eccentricity of the corrugation mounts 7 and 7a, respectively, which are rotatably connected together to the support shaft. The corrugators 8, 8a; 8', 8a' are thus driven by rotating the heads 1a, 1c; the corrugator 8a is not driven by the disc 11 and pins 16.

Figure 3:
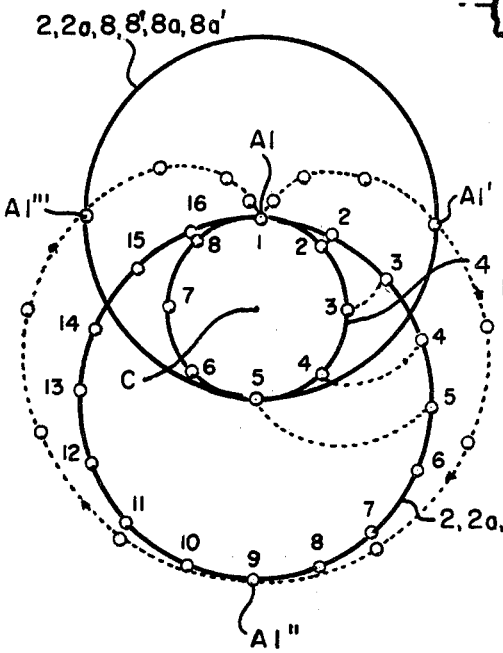
FIG. 3 is a travel path diagram of the corrugator and pipe in accordance with FIGS. 1 and 2 of the invention.

FIG. 3 shows the path of travel of an engagement point of a corrugator rolling bushing 8, 8', 8a or 8a'. The point $A_1$ after half a revolution of the corrugator head 1a is at the point $A_1'$, after one revolution of the corrugator head 1a, at the point $A_1''$, after 1.5 revolutions of the corrugator head at the point $A_1'''$ and after two revolutions of the corrugator head back at the point $A_1$. As can be clearly noted, the path of travel is a so-called cardinoid curve.

The essential advantage of the device of the invention is that with it there can be produced an annular corrugation with the apparatus of FIG. 1 or a helical corrugation with the apparatus of FIG. 2 which is so uniformly and cleanly sized that it fully satisfies the high requirements of high-frequency applications, e.g. waveguides. Corrugated pipes, particluarly those made of copper, are used for transmission of high-frequency electromagnetic waves. Thus, for instance, waveguides are developed as corrugated pipes as are also coaxial high-frequency cables which consist of two corrugated tubes which are held together concentrically by suitable spacers. High-frequency cables are also known in which a layer of foam is arranged on the solid or tubular inner conductor, over which foam a corrugated pipe is placed as an outside conductor.

However, it is also possible to manufacture pipes with particularly deep corrugations by means of the device in accordance with the invention. This is because of the large difference in diameter between the corrugator rolling bushings 8, 8a; 8', 8a' and the pipe 4 and due to the fact that the eccentricity of the corrugators 2 and 2a, respectively, is equal to the pipe radius in the vicinity of a corrugation valley.

Figure 4:
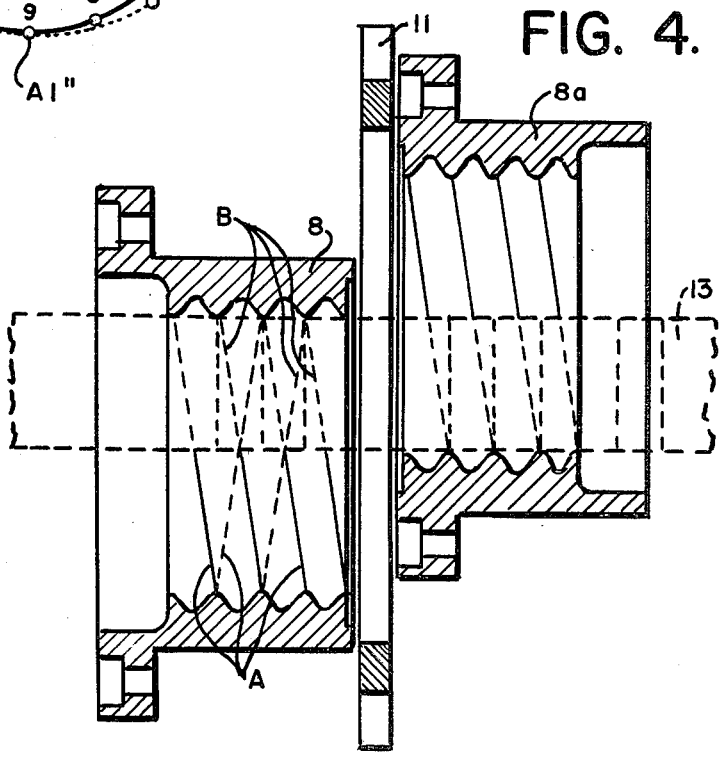
FIG. 4 is a longitudinal cross-section of a corrugator rolling bushing of FIG. 1 formed with multi-threads as the deformation rib.

FIG. 4 shows an apparatus of FIG. 1, however, with the deformation rib of the corrugator rolling bushings 8, 8a being formed as a multi-thread screw with two separate threads A and B for the shaping of several annular corrugations simultaneously on the pipe 13.

Figure 5:
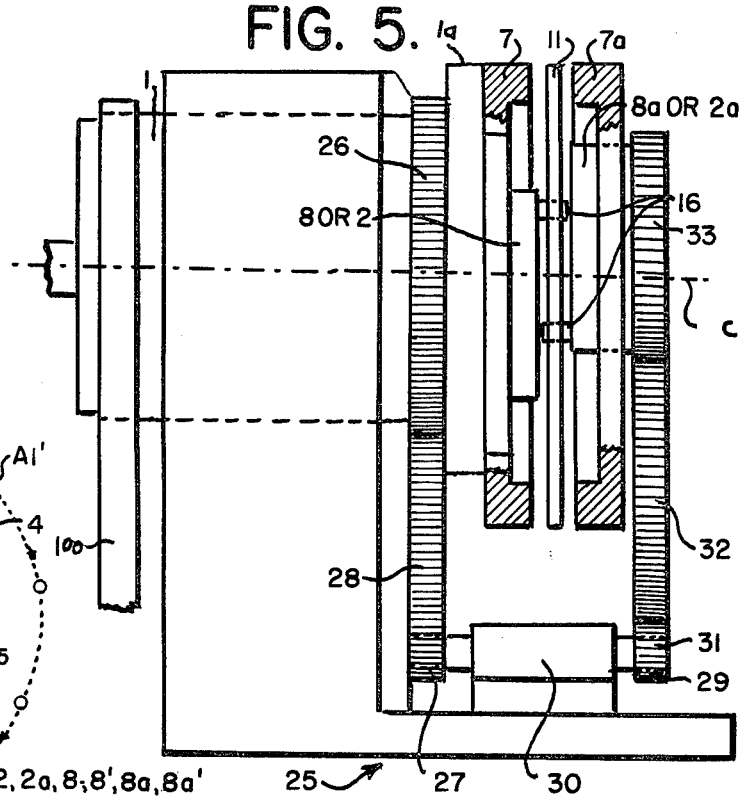
FIG. 5 is an elevational view showing a gear drive for the corrugator head.

FIG. 5 shows an embodiment in which the corrugators 2, 2a and the corrugator rolling bushings 8, 8a are coupled by a gearing 25 with the drive of the corrugator head 1a. The driven hollow shaft 1 is driven by a shaft drive 100. A gear wheel 26 mounted to the hollow shaft and corrugator mount 7 for joint rotation therewith drives a gear wheel 27 via a toothed belt 28 engaging around the gears 26 and 27. The gear 27 is connected with another gear 29 via a gearing transmission 30 for a corrugator bushing drive 31. A toothed belt 32 engages the gear 29 and a gear 33, the latter being connected to the rolling bushing 8a or corrugator 2a or mount 7a for joint rotation therewith. The term "pipe" herein is also to be understood as including tubes or tubing.

While I have disclosed several embodiments of my invention, it is to be understood that these embodiments are given by example only and not in a limiting sense.

I claim:

1. In an apparatus for the corrugation of tube of plastically deformable material through which the tube is continuously passed in a direction of passage, comprising a corrugator rolling bushing having an inside surface formed with a deformation rib which is helical (when annular parallel corrugations are to be produced on the tube) of more than one thread, or, respectively, with at least one deformation rib acting on successive points viewed in the longitudinal direction of the tube (when helical corrugations are to be produced in the tube), said corrugator rolling bushing being supported for free rotation in a rotatable corrugator head, the inside diameter of the corrugator rolling bushing being larger than the diameter of the tube to be corrugated and the corrugator rolling bushing being supported eccentrically to the tube, the improvement wherein the ratio of the inner diameter of the inside diameter defined by the deformation rib to the outside diameter of the corrugated tube in the region of a corrugation valley thereof is n:1 where n is an even integer, with a maximum deviation of 5%.

2. The apparatus as set forth in claim 1, wherein the deformation rib comprises a plurality of annular ribs arranged equally spaced from each other and adapted to produce helical corrugations on the tube.

3. The apparatus as set forth in claim 1, wherein said maximum deviation is at most 1%.

4. The apparatus as set forth in claim 1 or 3, wherein said deformation rib comprises at least three thread turns.

5. The apparatus as set forth in claim 1, or 2, wherein said deformation rib comprise at least three said annular ribs.

6. The apparatus as set forth in claim 1, wherein said deformation rib has a height which increases from an inlet over a region until it reaches a maximum height.

7. The apparatus as set forth in claim 6, wherein said deformation rib is a threading and said inlet is a beginning of the threading.

8. The apparatus as set forth in claim 6, wherein said deformation rib comprises annular ribs.

9. The apparatus as set forth in claim 6 or 7, wherein said inlet defines an inlet range extending over at least 720 degrees.

10. The apparatus as set forth in claim 6 or 8, wherein said inlet defines an inlet range extending over at least two of said annular ribs.

11. The apparatus as set forth in claim 1, wherein said deformation rib comprises at least two deformation ribs in said corrugator rolling bushing constituting a multi-threading.

12. The apparatus as set forth in claim 1, further comprising an additional corrugator rolling bushing has another deformation rib corresponding to that of said first-mentioned deformation rib and is arranged in the corrugator head behind the first-mentioned corrugator rolling bushing as seen in the direction of passage of the tube with an eccentricity staggered 180 degrees with respect to that of the first-mentioned corrugator rolling bushing, and said additional corrugator rolling bushing is so aligned relative to the first-mentioned deformation rib of the first-mentioned corrugator rolling bushing that said another deformation rib engages into valleys of the corrugations produced in the tube.

13. The apparatus as set forth in claim 12, wherein said deformation rib is a helical thread adapted to produce annular corrugations on the tube, an annular disc between both of said corrugator rolling bushings is arranged concentrically relative to the tube and formed with two longitudinal slots extending in a radial direction thereof 180 degrees apart, pins arranged at facing ends of said bushings are guidably disposed in the slots, respectively.

14. The apparatus as set forth in claim 12, further comprising corrugators in which said corrugator rolling bushings are mounted, respectively, another corrugator head, said corrugators are freely rotatably disposed in and relative to said corrugator heads, respectively, means for driving said first-mentioned corrugator head, means comprising a transmission gearing for separately operatively driving said corrugators from said driving means.

15. The apparatus as set forth in claim 1, wherein said corrugator rolling bushing is mounted without play in the axial direction.

16. The apparatus as set forth in claim 15, further comprising a corrugator in which said corrugator rolling bushing is mounted, said corrugator is freely rotatably disposed in and relative to said corrugator head thereby supporting said corrugator rolling bushing for free rotation in the corrugator head, means for mounting said corrugator without play in the axial direction whereby said corrugator rolling bushing is mounted without play in the axial direction.

17. The apparatus as set forth in claim 1 or 2, wherein the eccentricity of the corrugator rolling bushing is equal to the radius of the tube in the area of the corrugation valley.

18. In an apparatus for the corrugation of tube of plastically deformable material, means for continuously passing the tube through the apparatus without rotation of the tube in a direction of passage, comprising a corrugator rolling bushing having an inside surface formed with a deformation rib acting on successive points viewed in the longitudinal direction of the tube, said corrugator rolling bushing being supported for free rotation in a rotatable corrugator head, the inside diameter of the corrugator rolling bushing being larger than the diameter of the tube to be corrugated and the corrugator rolling bushing being supported eccentrically to the tube, the improvement wherein the deformation rib comprising a plurality of annular ribs arranged equally spaced from each other and adapted to produce helical corrugations on the tube.

* * * * *